US006129209A

United States Patent [19]

Tchira

[11] Patent Number: 6,129,209

[45] Date of Patent: Oct. 10, 2000

[54] FLORAL MULTI-COMPARTMENT SLEEVE

[76] Inventor: Steven Tchira, 19100 Turnberry Way, Aventura, Fla. 33180

[21] Appl. No.: 09/258,910

[22] Filed: Mar. 1, 1999

[51] Int. Cl.[7] ..... B65D 85/50

[52] U.S. Cl. ..... 206/423; 47/84

[58] Field of Search ..... 47/84; 206/423; 229/87.5, 87.01, 87.13, 120.11, 120.18, 120.24

[56] References Cited

U.S. PATENT DOCUMENTS

| | | | |
|---|---|---|---|
| 3,271,922 | 9/1966 | Wallerstein et al. | 206/423 |
| 3,348,667 | 10/1967 | Beeby | 229/120.18 |
| 3,376,666 | 4/1968 | Leonard | 206/423 |
| 3,767,104 | 10/1973 | Bachman et al. | 206/423 |
| 4,065,877 | 1/1978 | Kelley | 206/423 |
| 4,333,267 | 6/1982 | Witte | 206/423 |
| 4,408,710 | 10/1983 | Aust | 229/120.11 |
| 4,413,725 | 11/1983 | Bruno et al. | 206/423 |
| 4,621,733 | 11/1986 | Harris | 206/423 |
| 5,242,107 | 9/1993 | De Nola | 229/120.18 |

*Primary Examiner*—Jim Foster

*Attorney, Agent, or Firm*—Robert J. Van Der Wall

[57] ABSTRACT

A sleeve apparatus for retaining cut stems of several different types of plants, where the stems each having a stem cut end, includes a tube of sheet material having a tube upper end and a tube lower end; at least one substantially longitudinal divider formed of sheet material extending across the interior of the tube and joined to cross-sectionally spaced apart points on the tube, defining at least two plant stem longitudinal compartments each having an open compartment upper end and an open compartment lower end, so that at least one plant stem may be fitted longitudinally through each of the compartments to an extent that each stem cut end protrudes out of the tube lower end for immersion in water. The tube preferably is longitudinally tapered to define a truncated cone. The sheet material preferably is flexible. The divider optionally defines compartments of equal size, or alternatively defines compartments of differing sizes. Several of the dividers preferably extend across the interior of the tube, the dividers intersecting and being connected to one of: the tube and one the divider. The invention also contemplates using one of the compartments for goods other than plant life, such as a vase, teddy bear, candy, or other gifts.

14 Claims, 2 Drawing Sheets

FLORAL MULTI-COMPARTMENT SLEEVE

BACKGROUND OF THE INVENTION

1. Field of the Invention

The present invention relates generally to the field of floral arrangement and presentation. More specifically the present invention relates to a sleeve for receiving and retaining the cut stems of various plants including flowers, the sleeve being internally divided into compartments for separating the plant stems by type or category, for subsequent removal and placement into a floral arrangement. The invention also contemplates using one of the compartments for goods other than plant life, such as a vase, teddy bear, candy, or other gifts.

The most common examples of groups of stems to be separated by these dividers are those of: feature flowers such as roses, carnations, alstomeria and sunflowers; fillers such as novibelgi, asters, gypsophilia and limonium; and greens such as leather leaf, tree fern, beargrass and eucalyptus. The stems have cut ends which protrude from a lower end of the sleeve, and several of the sleeves are placed together in a bucket containing water so that the cut ends remain immersed and draw water to extend the shelf life of the plant stems, particularly to keep flowers from wilting. The sleeve retains the plant stems for storage, transport to and display in a store, and for ultimate arrangement into a bouquet by a purchaser of the sleeve and stems.

The sleeve is formed of sheet material formed into a truncated cone configuration. At least one divider, preferably formed of the same sheet material, extends across the interior of the cone, dividing the cone interior into two or more longitudinal compartments.

2. Description of the Prior Art

There have long been wrappers and sleeves for retaining flower and other plant stems for sale in non-arranged form, while permitting protruding cut stem ends to be immersed in water to prolong shelf life. A problem with these prior devices has been that various types of plant stems in a given sleeve become intermingled, so that the person who purchases and tries to selectively remove them one by one to arrange them has to hunt for the type of plant stem desired at the moment, so that considerable effort and time is lost.

There is no known structure aimed at solving this problem, but a related structure is found in Aldrich, U.S. Pat. No. 5,477,637, issued on Dec. 26, 1995, for a floral bouquet stem separator. Aldrich includes a substantially rigid separator plate having flower stem passing holes and a conventional tying element such as a rubber band. The flower stems are fitted through the plate holes, in their final floral arrangement, so that the holes cause the stems to fan outwardly from the tying element at a sharper angle than they would without the plate, to make the arrangement appear fuller and larger. A problem with Aldrich is that the perforated plate, if supplied with non-arranged flowers, an outer wrapper would still be required to retain and protect the flowers in each given bundle. The device is also relatively bulky compared to the present invention and could be relatively more expensive.

It is a principal object of the present invention to provide a floral sleeve which keeps plant stems separated into groups such as by type, color or other category for ease in individual, selective removal of the stems from the sleeve to create a floral arrangement.

It is another object of the present invention to provide such a sleeve which is capable of configuration during manufacture to separately retain two, three or more such groups of plant stems in any of a range of desired numerical proportions.

It is still another object of the present invention to benefit the final consumer with an appreciation of the freshness of the various flowers or plant varieties in a separated format, because freshness is not as easily detected when the same are intermingled in an arranged bouquet.

An additional object of the present invention is to allow consumers a choice of not buying an arranged bouquet because some consumers prefer to do their own arranging, but lack the knowledge of which varieties go well together. The invention accordingly contemplates experts preselecting and packaging in a single compartmented sleeve different varieties appropriate to each other for arrangement after purchase by the consumer.

A further object of the present invention to provide such a sleeve which can collapse laterally and be folded for compact storage and transport prior to filling with plant stems.

One more object of the invention is utilize the inventive structure to package together plant life and other things such as a vase, teddy bear, candy, or other gifts.

It is finally an object of the present invention to provide such a sleeve which is simple in construction, lightweight, easy to use and highly inexpensive to manufacture.

SUMMARY OF THE INVENTION

The present invention accomplishes the above-stated objectives, as well as others, as may be determined by a fair reading and interpretation of the entire specification.

A sleeve apparatus is provided for retaining cut stems of several different types of plants, the stems each having a stem cut end, the apparatus including a tube of sheet material having a tube upper end and a tube lower end; at least one substantially longitudinal divider formed of sheet material extending across the interior of the tube and joined to cross-sectionally spaced apart points on the tube, defining at least two plant stem longitudinal compartments each having an open compartment upper end and an open compartment lower end. The tube is preferably sized relative to the given plant stems so that at least one of the plant stems may be fitted longitudinally through each of the compartments to an extent that each stem cut end protrudes out of the tube lower end for immersion in water.

The tube preferably is longitudinally tapered to define a truncated cone. The sheet material for the tube and for the at least one divider is preferably flexible. The dividers optionally define compartments of equal size, or alternatively define compartments of differing sizes. Several of the dividers preferably extend across the interior of the tube, the dividers intersecting and being connected to one of: the tube and a divider.

The tube upper end preferably includes at least one handle opening for carrying the apparatus when the apparatus contains plant stems.

A sleeve apparatus is further provided, including cut stems of several different types of plants, the stems each having a stem cut end; a tube of sheet material having a tube upper end and a tube lower end; at least one substantially longitudinal divider formed of sheet material extending across the interior of the tube and joined to cross-sectionally spaced apart points on the tube, defining at least two plant stem longitudinal compartments each having an open compartment upper end and an open compartment lower end.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
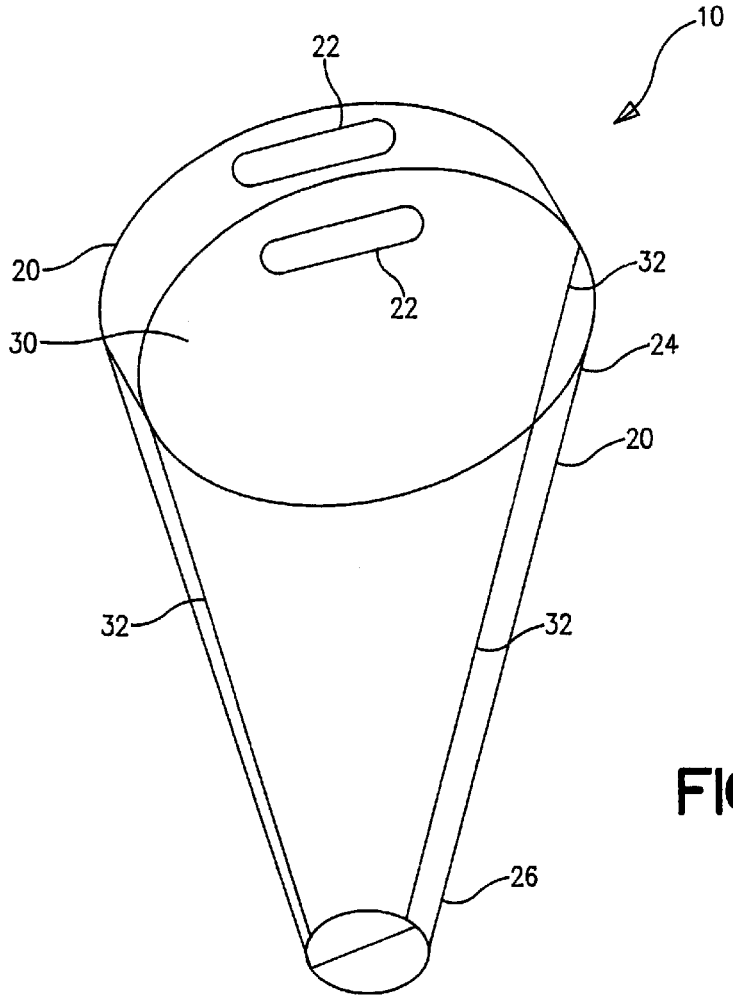
FIG. 1 is a perspective view of the preferred embodiment of the inventive floral sleeve apparatus, having a single diametric divider and optional handle openings.
Figure 2:
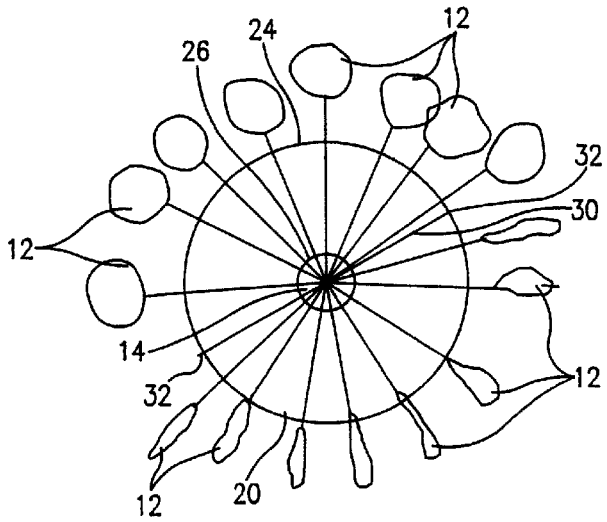
FIG. 2 is a top view of the apparatus of FIG. 1, showing plant stems divided by type fitted into each of the two longitudinal compartments.
Figure 3:
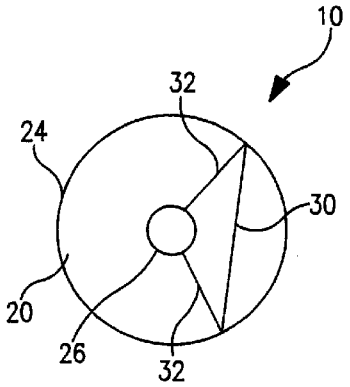
FIG. 3 is a top view of one embodiment of the apparatus having a single, off-center divider.
Figure 4:
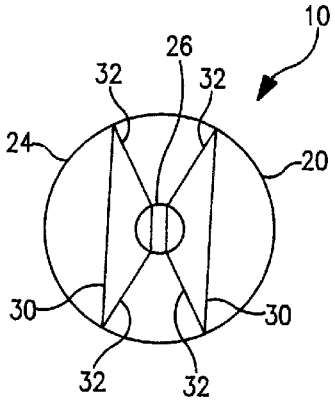
FIG. 4 is a top view of one embodiment of the apparatus having two parallel dividers.
Figure 5:
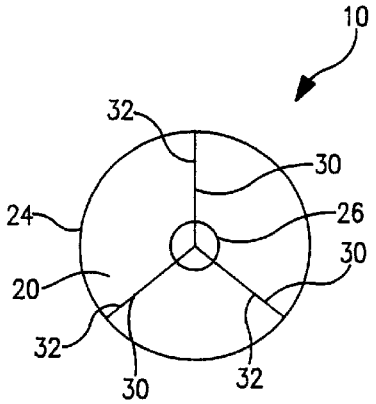
FIG. 5 is a top view of one embodiment of the apparatus having an off-center divider bowed laterally and connected at its mid-section to a second divider which retains the first divider in the bowed configuration to define three equal radial compartments.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Referring to FIGS. 1–9, a floral retaining sleeve apparatus 10 is disclosed for receiving and retaining the cut stems 12 of various plants including flowers, for subsequent reorganizing into a floral arrangement. Apparatus 10 includes a tube 20 which is internally divided into longitudinal compartments 14 by dividers 30 for separating the plant stems 12 by type, color or by other categorization.

The stems 12 have cut ends 12 which protrude from a lower end 26 of tube 20. The tube 20 is formed of sheet material coiled into a truncated cone configuration. At least one divider 30, preferably formed of the same sheet material, extends across the interior of the tube 20, dividing the cone interior longitudinally into two or more compartments 14.

Tube 20 at the tube upper end 24, and optionally one or more dividers 30, preferably include two or more registering handle openings 22 for carrying apparatus 10 when apparatus 10 contains plant stems 12. Handle openings 22 are each preferably laterally elongated and rounded at each opening lateral end so that a hand may be passed comfortably through each opening 22.

Where two compartments 14 of equal size are desired, a single diametric divider 30 is provided. See FIG. 2. Alternatively, where a larger proportion of one type of plant stem 12 relative to other type of plant stems 12 is appropriate for a given floral arrangement, the divider 30 may pass to one side of a diametric line in the manner of a geometric cord. See FIG. 3. Several parallel dividers 30 may be provided, or radial dividers 30 intersecting at the longitudinal axis of tube 20. See FIGS. 4 and 5, respectively. The radial divisions, once again, may be equally spaced or may define larger and smaller compartments 14 where differing quantities of given stems 12 are desired for a particular type of arrangement. Finally, the dividers 30 may intersect each other in a cross-sectional web configuration, defining several compartments of various or equivalent sizes. See FIG. 6.

The lateral ends 32 of each divider 30 intersect and are joined to either tube 20 or to another divider 30, such as by heating and melding the sheet material segments together. A single divider 30 may be pulled into an angled shape by the edge of another divider 30 connected to it, for simplicity of manufacture. See FIG. 5.

The apparatus 10 sheet material is preferably lightweight, flexible and transparent. The sheet material is preferably formed of BOPP, CPP, or KPP. Forming apparatus 10 of flexible sheet material has the advantage of being laterally collapsible and foldable for lightweight, compact transport and storage of empty units of apparatus 10. Apparatus 10 flexibility also provides the advantage of permitting tube 20 and dividers 30 to bow laterally when filled with plant stems 12 so that apparatus 10 configures itself to accommodate the shapes and volumes of a range of types and quantities of stems 12. See FIG. 7.

Figure 8:
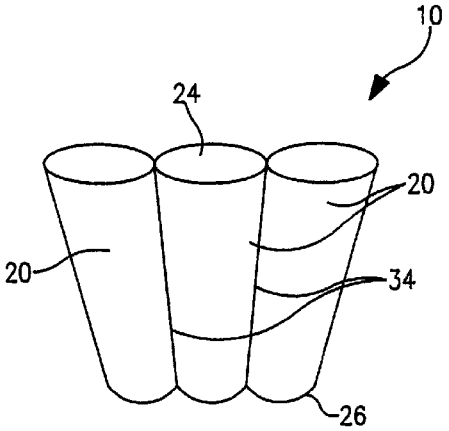
FIG. 8 is a perspective view of an alternative embodiment of the invention in which the plant stem compartments are linearly adjacent each other by reason of the tube of each compartment being attached to the tub of another compartment.
Figure 6:
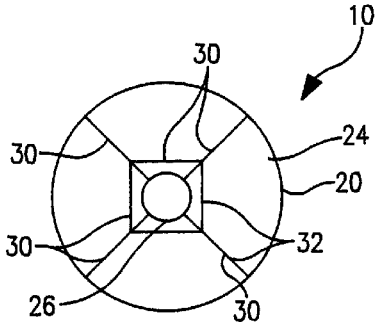
FIG. 6 is a top view of one embodiment of the apparatus having several dividers forming a web cross-sectional configuration.

FIG. 8 is a perspective view of an alternative embodiment of the apparatus 10 in which the tubes 20 of the plant stem compartments are linearly adjacent each other by reason of the tube 20 of each compartment being attached to the tube 20 of another compartment along an attachment junction 34.

Figure 9:
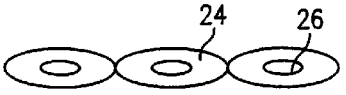
FIG. 9 is a top view of the alternative embodiment of FIG. 8 showing both the open compartment upper end and open compartment lower end of the linearly adjacent stem compartments.
Figure 7:
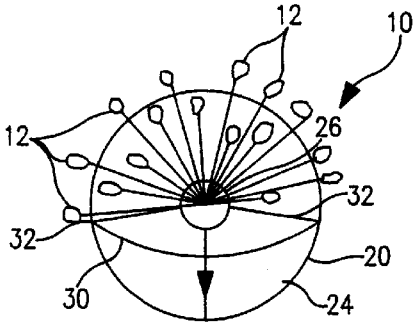
FIG. 7 is a top view of one embodiment of the apparatus having a single diametric divider bowed laterally by a greater quantity or volume of plant stems in the compartment shown at the top than in the compartment shown in the bottom of the figure. This illustrates the ability of flexible dividers in a given apparatus to accommodate a range of different plant stem proportions.

FIG. 9 is a top view of the FIG. 8 alternative embodiment showing both the open compartment upper end 24 and open compartment lower end 26 of the linearly adjacent stem compartments.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A sleeve apparatus for retaining at least cut stems of a plurality of different types of plants, the stems each having a stem cut end, the apparatus comprising:

at least one truncated cone configured tube of flexible and laterally collapsible sheet material having a tube upper end and a tube lower end; and a plurality of plant stem compartments separated by flexible and laterally collapsible sheet material, the plant stem compartments being linearly adjacent each other by reason of the tube of each compartment being attached to the tube of another compartment, each compartment having an open upper end and an open lower end.

2. The apparatus of claim 1 in which adjacent tubes are attached along an attachment junction.

3. The apparatus of claim 1, in which the plurality of plant stem compartments is accomplished with a single tube in which is disposed at least one substantially longitudinal divider formed of sheet material extending across the interior of the tube and joined to spaced apart points on the tube.

4. The apparatus of claim 3, wherein dividers define compartments of equal size.

5. The apparatus of claim 3, wherein dividers define compartments of differing sizes.

6. The apparatus of claim 3, wherein a plurality of the dividers extend across the interior of the tube, the dividers intersecting and being connected to one of: the tube and the divider.

7. The apparatus of claim 1, wherein the tube upper end comprises at least one handle opening to carry the apparatus when the apparatus contains plant stems.

8. The apparatus of claim 1 wherein a compartment contains goods other than plant life selected from the group of a vase, teddy bear, candy, and gifts.

9. A sleeve apparatus for retaining cut stems of a plurality of different types of plants, the stems each having a stem cut end, the apparatus comprising:

at least one truncated cone configured tube of flexible and laterally collapsible sheet material having an open upper end and an open lower end, and at least one substantially longitudinal flexible and laterally collapsible divider to separate compartments in the interior of the tube, the compartments being individual tubes linearly adjacent each other with the divider being a junction line connecting the tube of each compartment to the tube of another compartment.

10. The apparatus of claim 9 in which a plurality of compartments is accomplished with a single tube in which is disposed at least one substantially longitudinal divider formed of sheet material extending across the interior of the tube and joined to spaced apart points on the tube.

11. The apparatus of claim 9, wherein the divider defines compartments of equal size.

12. The apparatus of claim 9 wherein the divider defines compartments of differing sizes.

13. The apparatus of claim 9, wherein a plurality of dividers extend across the interior of the tube, the dividers intersecting and being connected to one of: the tube and a divider.

14. The apparatus of claim 9, wherein the tube upper end comprises at least one handle opening to carry the apparatus when the apparatus contains plant stems.

* * * * *